US011814879B2

(12) United States Patent
Kim et al.

(10) Patent No.: US 11,814,879 B2
(45) Date of Patent: Nov. 14, 2023

(54) VEHICLE AND VEHICLE TAILGATE LOCKING DEVICE

(71) Applicants: Hyundai Motor Company, Seoul (KR); Kia Motors Corporation, Seoul (KR)

(72) Inventors: Ki Eun Kim, Hwaseong-si (KR); Manhee Cho, Yongin-si (KR); Cheol Ho Lee, Bucheon-si (KR); Seungwon You, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 188 days.

(21) Appl. No.: 17/113,508

(22) Filed: Dec. 7, 2020

(65) Prior Publication Data

US 2022/0018166 A1 Jan. 20, 2022

(30) Foreign Application Priority Data

Jul. 14, 2020 (KR) ..... 10-2020-0086680

(51) Int. Cl.
*E05B 81/06* (2014.01)
*E05B 81/14* (2014.01)
*E05B 83/18* (2014.01)
(Continued)

(52) U.S. Cl.
CPC ..... *E05B 81/06* (2013.01); *E05B 81/15* (2013.01); *E05B 81/58* (2013.01); *E05B 83/18* (2013.01);
(Continued)

(58) Field of Classification Search
CPC ..... E05B 81/58; E05B 81/76; E05B 83/18; E05B 81/06; E05B 81/15; E05B 81/30;
(Continued)

(56) References Cited

U.S. PATENT DOCUMENTS 5,203,112 A * 4/1993 Yamagishi ..... E05B 81/20 49/360
5,613,716 A * 3/1997 Cafferty ..... E05B 77/36 292/201
(Continued)

FOREIGN PATENT DOCUMENTS

JP 2001123722 A * 5/2001 ..... E05B 81/20
JP 2005256466 A * 9/2005
WO WO-2011013585 A1 * 2/2011 ..... E05B 81/20

*Primary Examiner* — Kristina R Fulton
*Assistant Examiner* — Emily G. Brown
(74) *Attorney, Agent, or Firm* — Slater Matsil, LLP

(57) ABSTRACT

A vehicle tailgate locking device including an external door handle switch configured to be turned on and off in response to operation of an external door handle, a latch assembly including a latch member configured to engage or disengage a striker by rotation, a pawl member configured to restrain or release the latch member, and a latch motor configured to rotate the pawl member to release the latch member, and a controller configured to control power to be supplied to the latch motor in response to the external door handle switch being turned on, to stop the power supplied to the latch motor in response to either the external door handle switch being turned off after the external door handle switch is turned on or an elapse of a preset time.

20 Claims, 7 Drawing Sheets

(51) Int. Cl.

| | |
|---|---|
| ***E05B 85/10*** | (2014.01) |
| ***E05B 81/58*** | (2014.01) |
| ***E05B 81/56*** | (2014.01) |
| ***E05B 81/66*** | (2014.01) |
| ***E05B 81/76*** | (2014.01) |
| ***E05B 85/24*** | (2014.01) |
| ***E05B 85/04*** | (2014.01) |

(52) U.S. Cl.
CPC ..... *E05B 85/04* (2013.01); *E05B 85/10* (2013.01); *E05B 85/24* (2013.01); *E05B 81/56* (2013.01); *E05B 81/66* (2013.01); *E05B 81/76* (2013.01)

(58) Field of Classification Search
CPC ..... E05B 81/66; E05B 81/56; E05B 85/24; E05B 85/10
See application file for complete search history.

(56) References Cited

U.S. PATENT DOCUMENTS

| | | | | |
|---|---|---|---|---|
| 5,901,991 | A * | 5/1999 | Hugel | E05B 81/68 292/216 |
| 7,210,713 | B2 * | 5/2007 | Yoshida | E05B 81/66 292/216 |
| 9,567,781 | B2 * | 2/2017 | Lim | E05B 77/32 |
| 2003/0171864 | A1 * | 9/2003 | Mushiake | E05B 81/58 701/45 |
| 2016/0076277 | A1 * | 3/2016 | Kouzuma | E05C 3/12 292/201 |
| 2016/0153216 | A1 * | 6/2016 | Funahashi | E05B 77/12 292/2 |
| 2018/0171684 | A1 * | 6/2018 | Lange | E05B 81/58 |
| 2018/0195318 | A1 * | 7/2018 | Katagawa | E05B 81/64 |
| 2019/0112843 | A1 * | 4/2019 | Kim | E05B 81/76 |

* cited by examiner

VEHICLE AND VEHICLE TAILGATE LOCKING DEVICE

CROSS-REFERENCE TO RELATED APPLICATIONS

This application claims priority to Korean Patent Application No. 10-2020-0086680, filed on Jul. 14, 2020, which application is hereby incorporated herein by reference.

TECHNICAL FIELD

The disclosure relates to a vehicle and a vehicle tailgate locking device.

BACKGROUND

A tailgate locking device disposed at the rear of a passenger vehicle or van can be unlocked by operating a switch disposed on a driver's seat side or an external door handle provided outside the tailgate.

The tailgate locking device may include a striker fixed to a vehicle body, and a latch assembly for engaging or disengaging the striker. The latch assembly includes a latch member rotatably disposed in a housing and configured to restrain or release the striker by rotation, a pawl member restraining or releasing the latch member to maintain or release a locked state, and a driving device actuating the pawl member to release the latching member by the operation of a driver.

The driving device of the latch assembly operates the pawl member to release the restraint of the latch member when electrical power is supplied. The latch member released from the pawl member unlocks the tailgate by rotating in the direction of releasing the restraint of the striker.

In the tailgate locking device, the time to supply power to the driving device for unlocking is very short. That is, the driving device is returned to the home position after operating the pawl member in the releasing direction for a short time. Accordingly, a problem can occur in that the tailgate locking device is locked by returning the pawl member again when the latch member does not rotate to the unlocked state within the short time for which the driving device operates. However, it is also not good to make the time for supplying electric power to the driving device too long. When the driving device is operated for a long time and the release time of the latch member becomes long, the tailgate locking device may not lock when the tailgate is opened for a short time and then immediately closed.

Conventionally, in order to solve this problem, a full open switch and a full lock switch are applied to prevent half lock from being jammed, but there is a problem that the number of parts and the cost increase due to the addition of the full open switch.

SUMMARY

The disclosure relates to a vehicle and a vehicle tailgate locking device. Particular embodiments relate to a vehicle tailgate locking device capable of stabilizing lock and unlock operations of a tailgate.

An embodiment of the disclosure provides a vehicle capable of preventing half lock of a tailgate locking device by excluding a full open switch and improving control logic with only a full lock switch.

Additional embodiments of the disclosure will be set forth in part in the description which follows and, in part, will be obvious from the description, or may be learned by practice of the disclosure.

In accordance with an embodiment of the disclosure, a vehicle tailgate locking device may include an external door handle switch configured to be turned on and off in response to operation of an external door handle, a latch assembly including a latch member configured to engage or disengage a striker by rotation, a pawl member configured to restrain or release the latch member, and a latch motor configured to rotate the pawl member to release the latch member, and a controller configured to control power to be supplied to the latch motor in response to the external door handle switch being turned on, to stop the power supply to the latch motor in response to either the external door handle switch being turned off after the external door handle switch is turned on or the elapse of a preset time.

The controller may be configured to stop the power supply to the latch motor in response to an event that occurs earlier in time among the turning off of the external door handle switch and the elapse of the preset time.

The pawl member may be configured to maintain an unlocked state while the power is supplied to the latch motor. In response to the power supply to the latch motor being stopped, the pawl member may be configured to be converted to a lock state.

The latch member may be configured to be converted from a full lock state to a full open state through a half lock state by driving the latch motor.

The external door handle may be configured on a tailgate provided to open or close one side of the vehicle.

BRIEF DESCRIPTION OF THE DRAWINGS

These and/or other aspects of the disclosure will become apparent and more readily appreciated from the following description of the embodiments, taken in conjunction with the accompanying drawings, in which.

DETAILED DESCRIPTION OF ILLUSTRATIVE EMBODIMENTS

Figure 1:
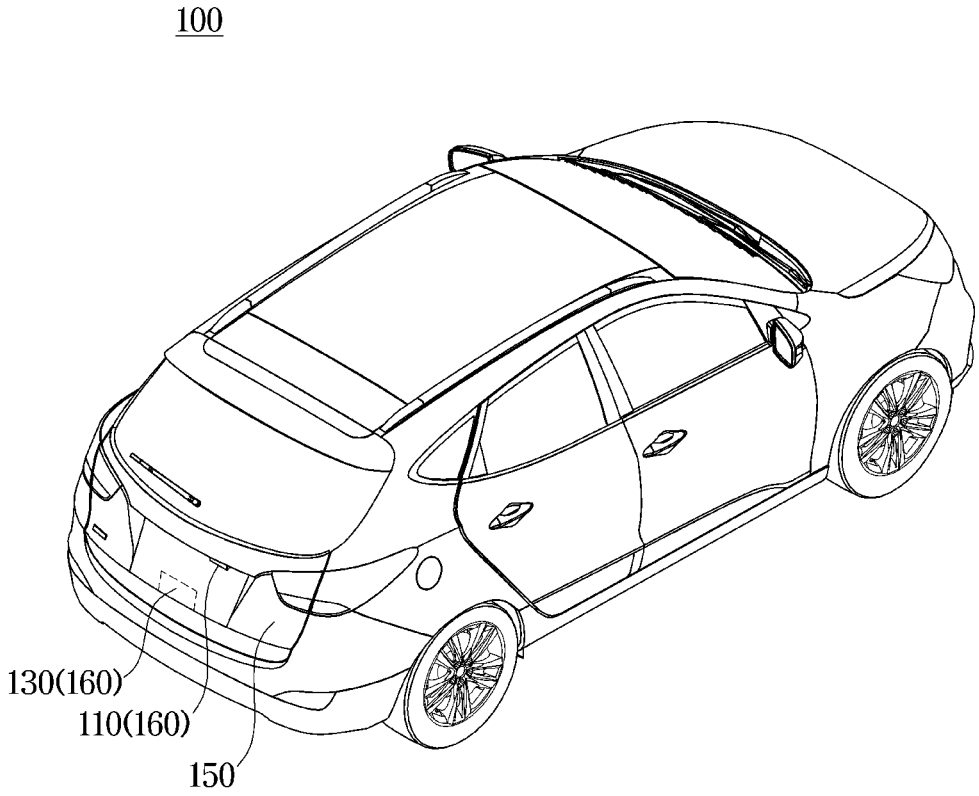
FIG. 1 is a view illustrating a vehicle according to an embodiment of the disclosure.

FIG. 1 is a view illustrating a vehicle according to an embodiment of the disclosure. In particular, a tailgate and a tailgate locking device of a vehicle 100 are illustrated in FIG. 1.

A tailgate is a term that refers to a rear door of a spoils utility vehicle (SUV), a recreational vehicle (RV), a station wagon, or a pickup truck. In FIG. 1, the SUV is illustrated as an example of a vehicle 100. As illustrated in FIG. 1, a tailgate 150 may be disposed at the rear of the vehicle 100 in a form of the SUV.

Just as all doors of the vehicle 100 are provided with locking devices, a tailgate locking device 160 is also provided in the tailgate iso. The tailgate locking device 160 may include an external door handle 110 and a latch assembly 130.

The external door handle 110 of the tailgate locking device 160 may be a device used by a user to open the tailgate 150 of the vehicle 100. The latch assembly 130 of the tailgate locking device 160 is mechanically engaged with a striker provided in the vehicle 100 to fix the tailgate 150 to a body of the vehicle 100.

When the tailgate 150 is locked (closed), when the user presses (or pulls) the external door handle 110, an electrical signal may be generated by the user's operation of the external door handle 110, and the electrical signal may be transmitted to the latch assembly 130. In response to receiving the electrical signal from the latch assembly 130, a series of mechanical actions are performed to release a lock state. The tailgate 150 may be opened by unlocking the latch assembly 130 and the rear of the vehicle 100 may be opened. A controller 202 (see FIG. 2) is interposed between the external door handle 110 and the latch assembly 130, which will be described in more detail in FIG. 2 to be described later.

Figure 2:
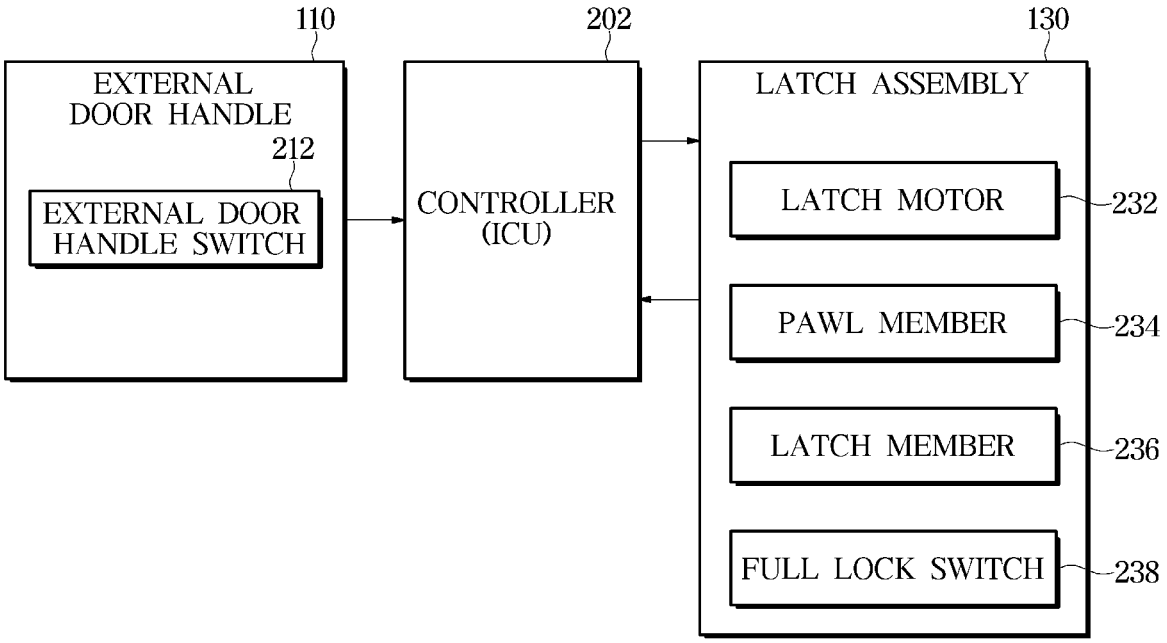
FIG. 2 is a view illustrating a control system of a vehicle tailgate locking device according to an embodiment of the disclosure.

FIG. 2 is a view illustrating a control system of a vehicle tailgate locking device according to an embodiment of the disclosure.

The controller 202 may be connected to enable communication between the external door handle 110 and the latch assembly 130. The controller 202 may be an Integrated Central Control Unit (ICU).

An external door handle switch 212 may be provided on the external door handle 110. When the user presses (or pulls) the external door handle 110, the external door handle switch 212 is turned on, thereby generating the electrical signal mentioned in the description of FIG. 1. The electrical signal generated by the turn-on of the external door handle switch 212 may be transmitted to the controller 202. The controller 202 may generate a control signal for controlling the latch assembly 130 in response to the reception of the electrical signal and transmit the control signal to the latch assembly 130.

The latch assembly 130 may include a latch motor 232, a pawl member 234, a latch member 236, and a full lock switch 238. In the latch assembly 130, the latch motor 232 may be driven (rotated) in response to the control signal from the controller 202, and the pawl member 234 and the latch member 236 may perform a predetermined series of operations by driving (rotation) by the latch motor 232. The latch motor 232 may be a driving device for rotating the pawl member 234. A series of operations of the latch member 236 may be performed within a predetermined operation range, and the operation of the latch member 236 may be detected by the full lock switch 238. The detection signal of the full lock switch 238 is transmitted to the controller 202 so that the controller 202 can recognize an operation state of the latch member 236.

Figure 3:
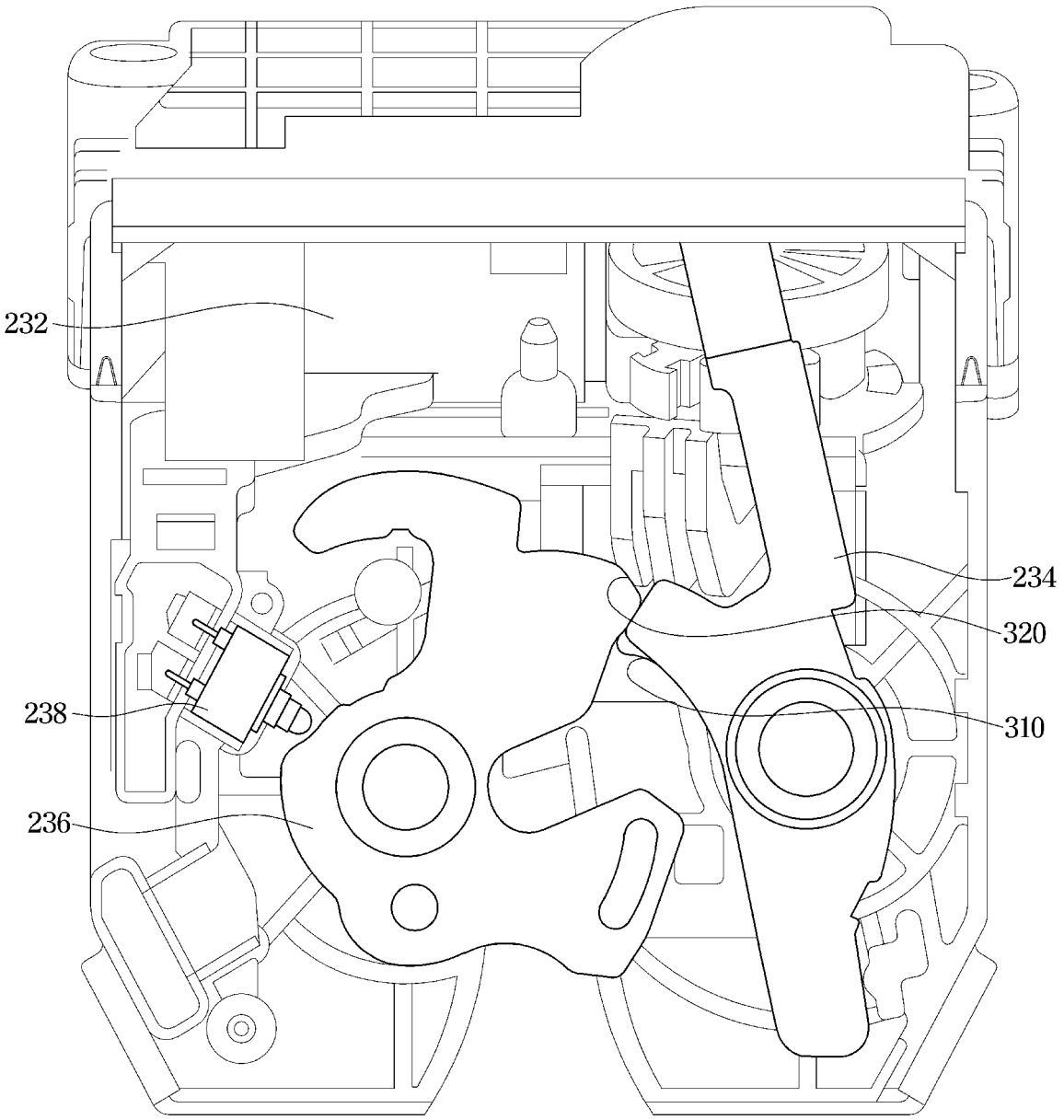
FIG. 3 is a view illustrating a full lock state of a latch assembly according to an embodiment of the disclosure.
Figure 4:
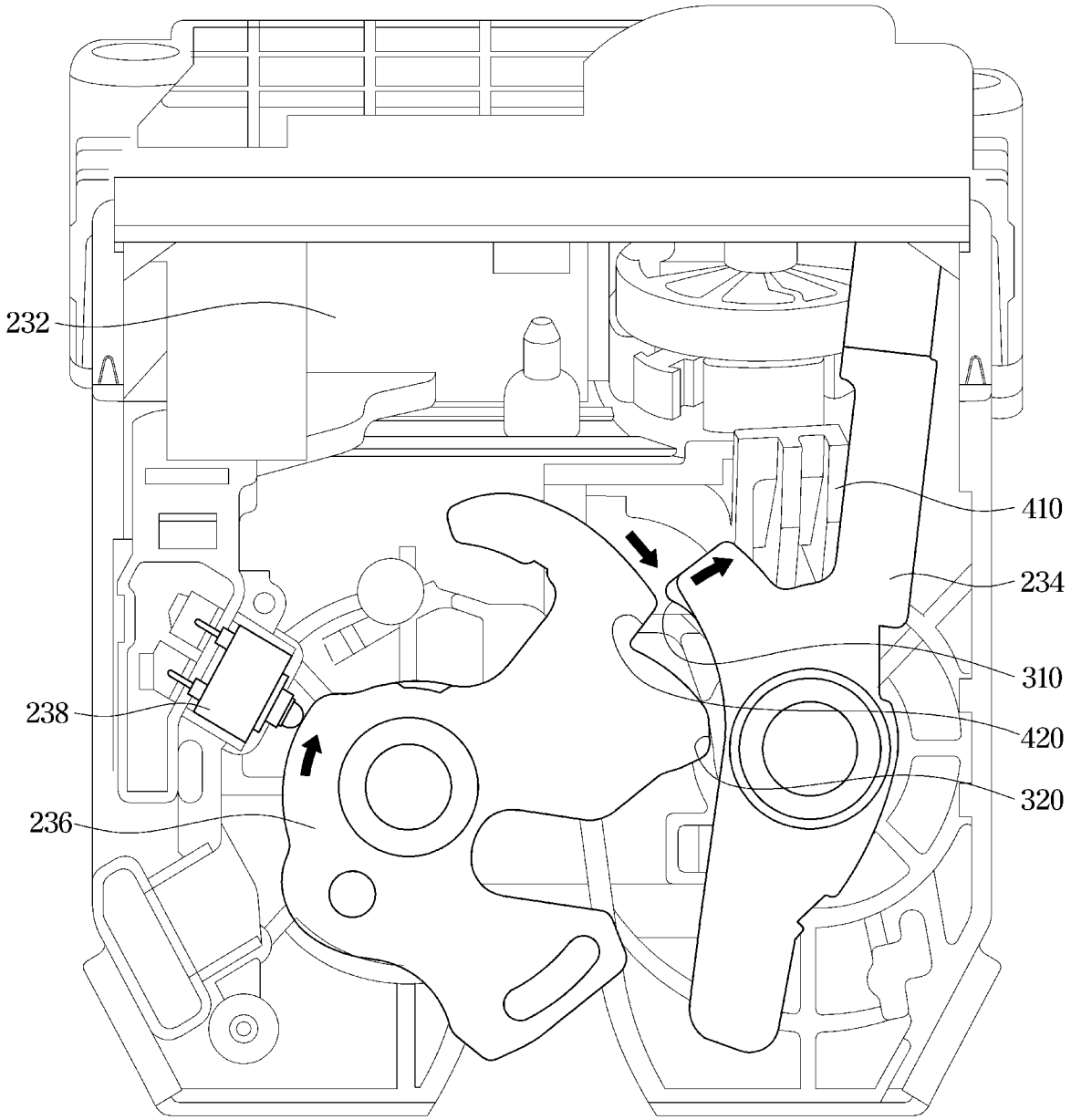
FIG. 4 is a view illustrating a state in which full open is started after half lock of a latch assembly according to an embodiment of the disclosure.
Figure 5:
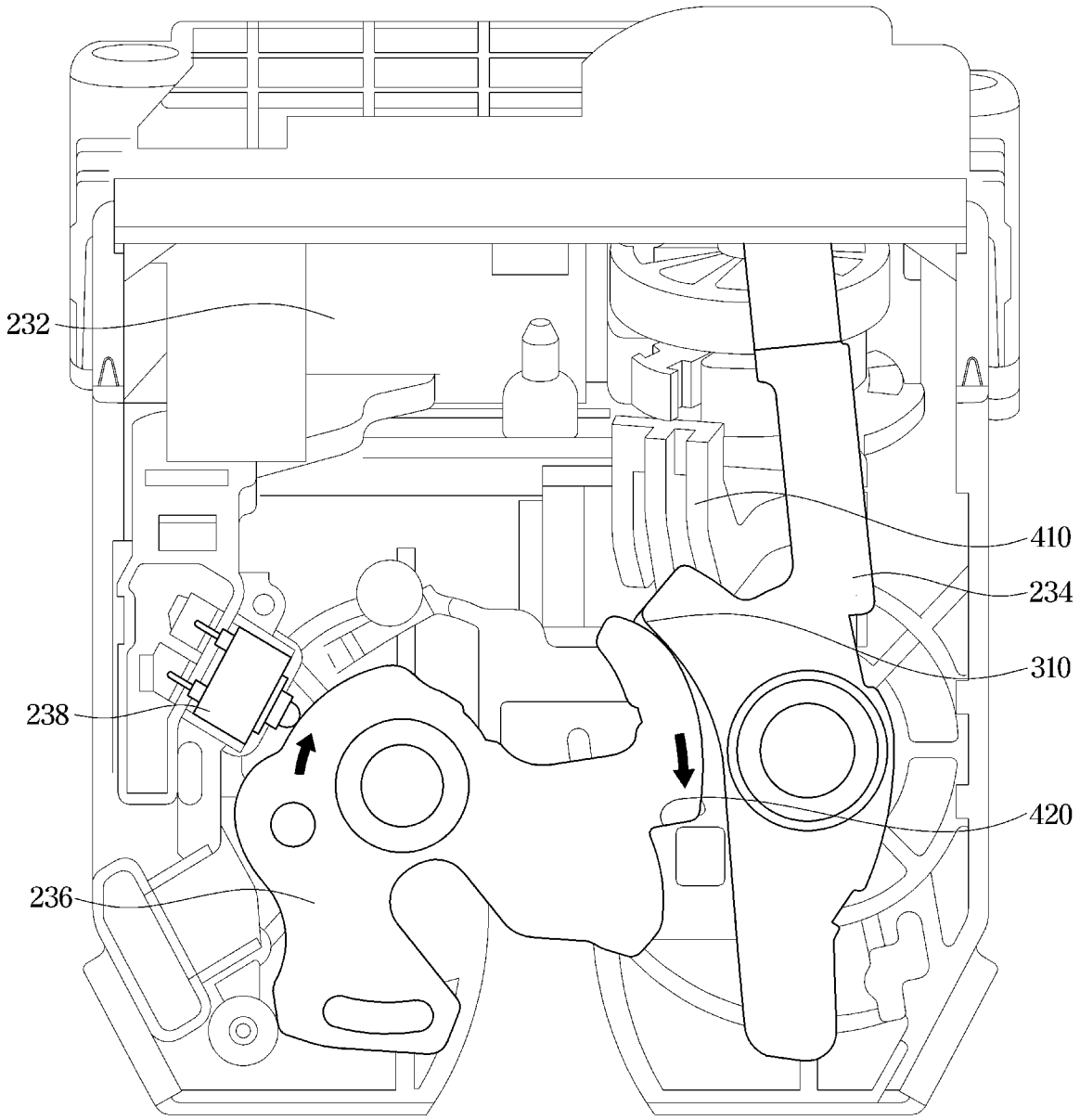
FIG. 5 is a view illustrating a full open state of a latch assembly according to an embodiment of the disclosure.

FIGS. 3 to 5 are views illustrating states of full lock, half lock, and full open of a latch assembly according to an embodiment of the disclosure.

FIG. 3 is a view illustrating a full lock state of a latch assembly according to an embodiment of the disclosure. That is, the latch assembly 130 is completely locked and the tailgate 150 of the vehicle 100 is not opened.

In the full lock state, the pawl member 234 is located as illustrated in FIG. 3, and a first engaging jaw 320 of the latch member 236 is caught and restricted by a restricting jaw 310 of the pawl member 234, thereby restricting the latch member 236 so that it cannot be rotated in a clockwise direction (based on the drawing). At this time, the latch member 236 is not in contact with the full lock switch 238, and thus the full lock switch 238 is not turned on. The controller 202 may recognize that the latch assembly 130 is in the full lock state through the fact that the full lock switch 238 is not turned on.

FIG. 4 is a view illustrating a state in which full open is started after half lock of a latch assembly according to an embodiment of the disclosure.

As previously described with reference to FIGS. 1 and 2, the electrical signal may be generated from the external door handle 110 while the user operates the external door handle no (while pressing or pulling). In response to the generation of the electrical signal, the controller 202 may generate the control signal. The control signal generated by the controller 202 may be transmitted to the latch assembly 130 to supply power to the latch motor 232 to drive the latch motor 232. A time (length) of driving by supplying power to the latch motor 232 will be described in more detail with reference to FIGS. 6 and 7 to be described later.

By driving the latch motor 232, an emergency lever 410 moves a certain distance from left to right in the drawing. A movement of the emergency lever 410 causes the pawl member 234 to rotate at a certain angle in the clockwise direction (based on the drawing). The restricting jaw 310 of the pawl member 234 moves with the rotation of the pawl member 234, and a restraining force applied by the restricting jaw 310 of the pawl member 234 to the first engaging jaw 320 of the latch member 236 is removed, and as a result, the latch member 236 rotates at the certain angle in the clockwise direction (based on the drawing).

As the latch member 236 rotates by the certain angle in the clockwise direction, the latch member 236 contacts the full lock switch 238 and turns on the full lock switch 238, and a second engaging jaw 420 of the latch member 236 is caught and restrained by the restricting jaw 310 of the pawl member 234, thereby preventing the latch member 236 from rotating in the clockwise direction (based on the drawing). This state may be a half lock state of the latch assembly 130. Accordingly, FIG. 4 is a view of a state in which full open starts after half lock.

FIG. 5 is a view illustrating a full open state of a latch assembly according to an embodiment of the disclosure.

While the operation of the external door handle 110 by the user continues (while pressing or pulling), the external door handle switch 212 is continuously turned on, and thus the latch motor 232 is also driven.

As illustrated in FIG. 5, the latch member 236 may continue to rotate in the clockwise direction, and the restraint is released from the pawl member 234.

Even at this time, the full lock switch 238 contacts the latch member 236 to maintain a turned on state, and the latch assembly 130 is in a full open state so that the user can completely open the tailgate 150 of the vehicle 100.

Figure 6:
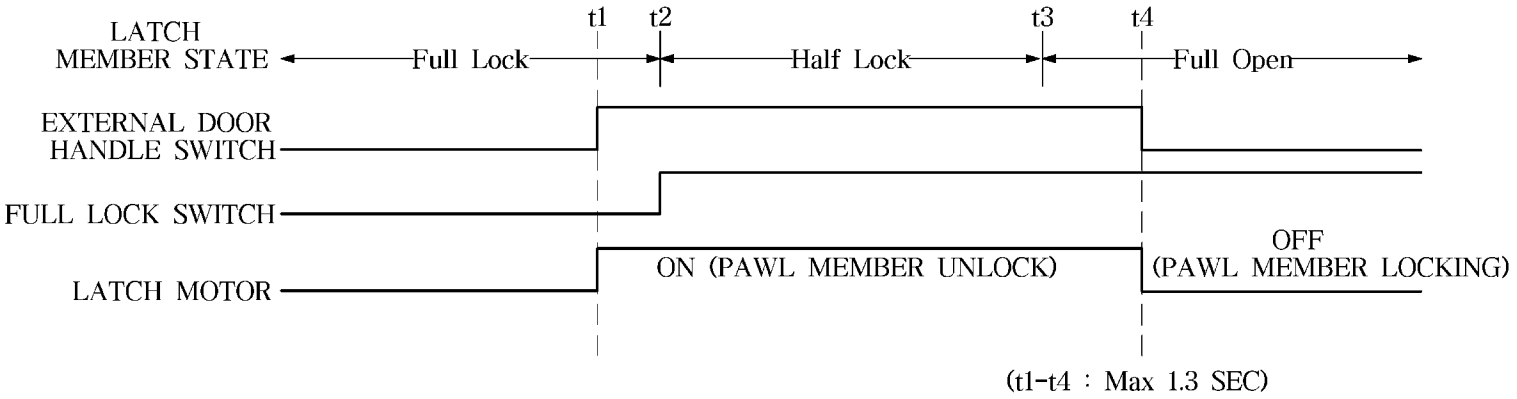
FIG. 6 is a view illustrating a control logic of a latch assembly of a vehicle according to an embodiment of the disclosure.

FIG. 6 is a view illustrating control logic of a latch assembly of a vehicle according to an embodiment of the disclosure.

That is, in FIG. 6, the latch member 236 of the latch assembly 130 illustrates the control signal related to the state of the latch member 236, the external door handle switch 212, the full lock switch 238, and the latch motor 232 from the full lock state (see FIG. 3) to the full open state (see FIG.

5) through the half lock state (see FIG. 4) by operating the external door handle 110 by the user.

As illustrated in FIG. 6, while the latch member 236 of the latch assembly 130 is in the full lock state, when the user operates (presses or pulls) the external door handle 110, the external door handle switch 212 may be turned (n). When the door handle switch 212 is turned on, power is supplied to the latch motor 232 so that the latch motor 232 starts to rotate (t1). At this time, the pawl member 234 is in an unlocked state.

By the rotation of the latch motor 232, the pawl member 234 may also start to rotate in the clockwise direction. Accordingly, the latch member 236 may be converted from the full lock state to the half lock state. The full lock switch 238 may be turned on when the latch member 236 is converted from the full lock state to the half lock state (t2).

While the operation of the external door handle 110 by the user continues, the latch member 236 continues to rotate and is converted to the full open state through the half lock state (t3). While the latch member 236 is in the full open state, when the user stops the operation of the external door handle 110 (t4), the external door handle switch 212 is turned off, and thus power supply to the latch motor 232 is blocked. At this point in time t4, the pawl member 234 may be converted to a locking state, that is, a lock state.

In an embodiment of the disclosure, two methods are proposed for switching the pawl member 234 from an unlocking state to the locking state by blocking power supply to the latch motor 232. In a first method, the power supply to the latch motor 232 may be blocked based on the user stopping the operation of the external door handle 110. In another method, when the user operates the external door handle 110 and a preset time elapses from the time t1 when the external door handle switch 212 is turned on, the power supply to the latch motor 232 is cut off. Here, the preset time may be a time to ensure that the latch member 236 is completely converted from the half lock state to the full lock state after the start of driving of the latch motor 232. The preset time may be, for example, a maximum of 1.3 seconds (1,300 ms). The preset time may have a different value depending on a structure of the latch assembly 130.

In the embodiments of the disclosure, both of these methods are applied, and power supply to the latch motor 232 is cut off at a shorter (earlier to arrive) point of time t4 determined by each of the two methods. When the user stops operating the external door handle 110 before a preset time (1.3 seconds) has elapsed, the power supply to the latch motor 232 is cut off in response to the turn off of the external door handle switch 212. On the other hand, when the user does not stop the operation of the external door handle 110 until the preset time (1.3 seconds) is reached, the power supply to the latch motor 232 is cut off at the preset time (1.3 seconds) regardless of whether the user operates the external door handle 110 or not.

Figure 7:
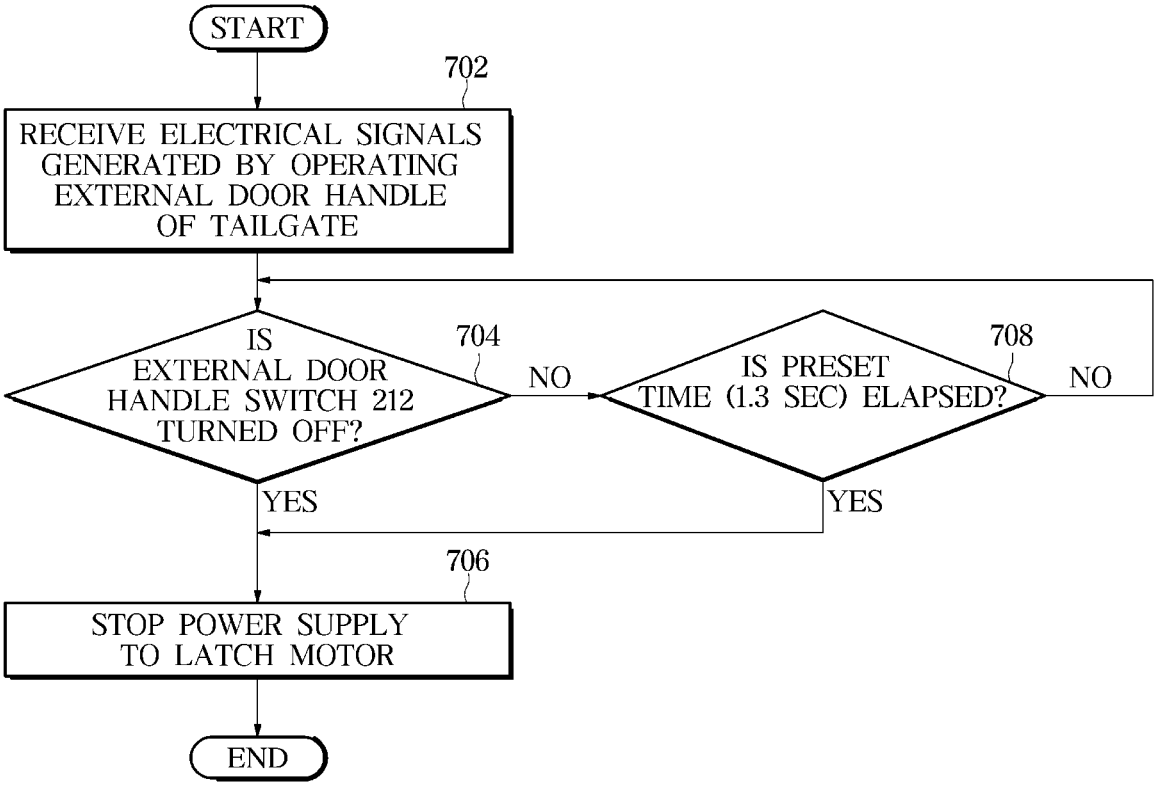
FIG. 7 is a view illustrating a method of controlling a vehicle according to an embodiment of the disclosure.

FIG. 7 is a view illustrating a method of controlling a vehicle according to an embodiment of the disclosure.

The vehicle control method illustrated in FIG. 7 is based on the device configuration of FIGS. 2 to 5 and the control logic of the latch assembly of FIG. 6.

First, the controller 202 may receive a plurality of electrical signals generated by operating the external door handle 110 of the tailgate 150 of the vehicle 100 (702). The electrical signal received by the controller 202 may include the electrical signal generated from the external door handle switch 212 by operation of the external door handle 110 and the electrical signal generated from the full lock switch 238 by rotation of the latch member 236 of the latch assembly 130.

The controller 202 may generate a control command for supplying power to the latch motor 232 of the latch assembly 130 in response to generation of the electrical signal generated from the external door handle switch 212 by operation of the external door handle 110. Accordingly, the latch motor 232 is driven, and a series of operations of the pawl member 234 and the latch member 236 as illustrated in FIGS. 3 to 5 may be performed.

In this state, the controller 202 may monitor whether the external door handle switch 212 is turned off (704). That is, it is identified whether the user stops the operation of the external door handle 110.

When the user stops the operation of the external door handle 110 and the external door handle switch 212 is turned off (YES in 704), the controller 202 may stop the power supply to the latch motor 232 (706).

Returning to operation 704 again, when the preset time (for example, 1.3 seconds) elapses while the user continues to operate the external door handle 110 without interrupting the operation (YES in 708), the controller 202 may stop the power supply to the latch motor 232 (706).

As described above, in the embodiment of the disclosure, two methods for switching the pawl member 234 from the unlocking state to the locking state by blocking the power supply to the latch motor 232 are proposed. In the first method, the power supply to the latch motor 232 is cut off based on the user stopping the operation of the external door handle 110. In another method, when the user operates the external door handle 110 and the preset time elapses from the time t1 when the external door handle switch 212 is turned on, the power supply to the latch motor 232 is cut off. Here, the preset time may be the time to ensure that the latch member 236 is completely converted from the half lock state to the full lock state after the start of driving of the latch motor 232. The preset time may be, for example, the maximum of 1.3 seconds (1,300 ms). The preset time may have a different value depending on the structure of the latch assembly 130.

In the embodiments of the disclosure, both of these methods are applied, and power supply to the latch motor 232 is cut off at a shorter (earlier to arrive) point of time t4 determined by each of the two methods. When the user stops operating the external door handle 110 before a preset time (1.3 seconds) has elapsed, the power supply to the latch motor 232 is cut off in response to the turn off of the external door handle switch 212. On the other hand, when the user does not stop the operation of the external door handle 110 until the preset time (1.3 seconds) is reached, the power supply to the latch motor 232 is cut off at the preset time (1.3 seconds) regardless of whether the user operates the external door handle 110 or not.

In the latch assembly 130 of the vehicle 100 according to the embodiments of the disclosure, a simpler structure of the latch assembly 130 is constructed with fewer parts by determining the time when the power supply to the latch motor 232 is cut off based on an operation completion time of the external door handle 110 (or when the preset time has elapsed) without using a separate means. In addition, even when the user attempts to open the tailgate 150 and then closes it quickly, since the user does not operate the external door handle 110, the power supply to the latch motor 232 is blocked, and the latch member 236 is not locked.

According to the embodiments of the disclosure, the half lock of the tailgate locking device may be prevented by excluding the full open switch and improving the control logic with only the full lock switch.

The disclosed embodiments are merely illustrative of the technical idea, and those skilled in the art will appreciate that various modifications, changes, and substitutions may be made without departing from the essential characteristics thereof. Therefore, the exemplary embodiments disclosed above and the accompanying drawings are not intended to limit the technical idea, but to describe the technical spirit, and the scope of the technical idea is not limited by the embodiments and the accompanying drawings. The scope of protection shall be interpreted by the following claims, and all technical ideas within the scope of equivalents shall be interpreted as being included in the scope of rights.

What is claimed is:

1. A vehicle tailgate locking device comprising:

an external door handle switch configured to be turned on and off in response to operation of an external door handle;

a latch assembly including a latch member configured to engage or disengage a striker by rotation, a pawl member configured to restrain or release the latch member, and a latch motor configured to rotate the pawl member to release the latch member; and a controller configured to control power to be supplied to the latch motor in response to the external door handle switch being turned on and to stop the power supplied to the latch motor in response to either the external door handle switch being turned off after the external door handle switch is turned on or an elapse of a preset time, wherein the preset time is a time to ensure that the latch member is converted from a half lock state to a full lock state after the power is supplied to the latch motor, and wherein the controller is configured to stop the power supplied to the latch motor in response to the first to occur of the external door handle switch being turned off and the elapse of the preset time.

2. The vehicle tailgate locking device according to claim 1, wherein:

the pawl member is configured to maintain an unlocked state while the power is supplied to the latch motor; and in response to the power supplied to the latch motor being stopped, the pawl member is configured to be converted to a lock state.

3. The vehicle tailgate locking device according to claim 1, wherein the latch member is configured to be converted from the full lock state to a full open state through the half lock state by driving the latch motor.

4. The vehicle tailgate locking device according to claim 1, wherein the external door handle is configured on a tailgate provided to open or close one side of a vehicle.

5. The vehicle tailgate locking device according to claim 1, wherein the latch assembly further comprises a full lock switch.

6. The vehicle tailgate locking device according to claim 1, wherein the latch member is configured to be converted from the full lock state to a full open state through the half lock state by driving the latch motor.

7. The vehicle tailgate locking device according to claim 1, wherein the pawl member is configured to maintain an unlocked state while the power is supplied to the latch motor.

8. The vehicle tailgate locking device according to claim 1, wherein the pawl member is configured to be converted to a lock state in response to the power supplied to the latch motor being stopped.

9. A vehicle comprising:

a vehicle body;

a tailgate connected to the vehicle body;

an external door handle connected to the tailgate;

an external door handle switch configured to be turned on and off in response to operation of the external door handle;

a striker fixed to the vehicle body;

a latch member configured to engage or disengage the striker by rotation;

a pawl member configured to restrain or release the latch member;

a latch motor configured to rotate the pawl member to release the latch member; and a controller configured to control a power supplied to the latch motor in response to the external door handle switch being turned on, to stop the power supplied to the latch motor in response to either the external door handle switch being turned off after the external door handle switch is turned on or an elapse of a preset time;

wherein the preset time is a time to ensure that the latch member is converted from a half lock state to a full lock state after the power is supplied to the latch motor; and wherein the controller is configured to stop the power supplied to the latch motor in response to the first to occur of the external door handle switch being turned off and the elapse of the preset time.

10. The vehicle according to claim 9, wherein:

the pawl member is configured to maintain an unlocked state while the power supply to the latch motor is on; and in response to the power supply to the latch motor being stopped, the pawl member is configured to be converted to a lock state.

11. The vehicle according to claim 9, wherein the latch member is configured to be converted from the full lock state to a full open state through the half lock state by driving the latch motor.

12. The vehicle according to claim 9, wherein the external door handle is configured to open or close the tailgate.

13. The vehicle according to claim 9, further comprising a full lock switch configured to detect operation of the latch member.

14. A method of controlling a vehicle tailgate locking device comprising an external door handle switch, a latch member, a pawl member, and a latch motor, the method comprising:

receiving a plurality of electrical signals generated by at least the external door handle switch in response to operation of an external door handle on a tailgate of a vehicle;

generating a control command for supplying power to the latch motor in response to the plurality of electrical signals;

determining whether the external door handle switch is turned off;

when it is determined that the external door handle switch is turned off, stopping supplying the power to the latch motor;

when it is determined that the external door handle switch is not turned off, determining whether a preset time has elapsed, wherein the preset time is a time to ensure that the latch member is converted from a half lock state to a full lock state after the power is supplied to the latch motor; and stopping supplying the power to the latch motor in response to the earlier in time of the external door handle switch being turned off and the elapse of the preset time.

15. The method of claim 14, wherein the plurality of electrical signals includes at least one of an electrical signal generated from the external door handle switch by operation of the external door handle or an electrical signal generated from a full lock switch by rotation of the latch member.

16. The method of claim 14, wherein determining whether the external door handle switch is turned off comprises identifying whether the operation of the external door handle has stopped.

17. The method according to claim 14, further comprising:

maintaining an unlocked state of the pawl member during supplying the power to the latch motor; and in response to stopping supplying the power to the latch motor, converting the pawl member to a lock state.

18. The method according to claim 14, further comprising converting the latch member from the full lock state to a full open state through the half lock state by driving the latch motor.

19. The method according to claim 14, further comprising opening or closing the tailgate by the operation of the external door handle.

20. The method according to claim 14, further comprising detecting operation of the latch member using a full lock switch of the vehicle tailgate locking device.

* * * * *